United States Patent [19]

Ouimet

[11] Patent Number: 4,779,665

[45] Date of Patent: Oct. 25, 1988

[54] DIE CASTING APPARATUS AND PROCESS COMPRISING IN-DIE PLUNGER DENSIFICATION TO FORM A BORE THROUGH A PRODUCT CASTING

[75] Inventor: Larry J. Ouimet, Massena, N.Y.

[73] Assignee: General Motors Corporation, Detroit, Mich.

[21] Appl. No.: 408,652

[22] Filed: Aug. 16, 1982

[51] Int. Cl.[4] ..... B22D 27/11

[52] U.S. Cl. ..... 164/120; 164/320

[58] Field of Search ..... 164/120, 319–321

[56] References Cited

U.S. PATENT DOCUMENTS 3,106,002 10/1963 Bauer ..... 164/120

4,380,261 4/1983 Suzuki et al. ..... 164/120

*Primary Examiner*—Nicholas P. Godici

*Assistant Examiner*—Richard K. Seidel

*Attorney, Agent, or Firm*—Douglas D. Fekete

[57] ABSTRACT

A die casting process and apparatus is described for forming a metal casting having a bore therethrough surrounded by dense, nonporous metal. During solidification, a plunger core is driven through the metal to substantially form the bore. The plunger core comprises a metal-penetrating conical tip that laterally displaces metal in response to plunger core advance to densify the metal about the bore. The plunger core tip is received into a correspondingly shaped recess so that only a thin metal flash is formed therebetween, which flash is readily removed by punching to complete the bore.

5 Claims, 2 Drawing Sheets

DIE CASTING APPARATUS AND PROCESS COMPRISING IN-DIE PLUNGER DENSIFICATION TO FORM A BORE THROUGH A PRODUCT CASTING

BACKGROUND OF THE INVENTION

This invention relates to an apparatus and process for die casting metal that includes driving a plunger core member into metal during solidification to densify the metal and concurrently to form a bore in a product casting. More particularly, the plunger core is adapted to be driven through the metal to substantially form a bore through the product casting that is surrounded by pore-free metal.

In U.S. patent application Ser. No. 391,106, an apparatus and process are described for die casting a metal article intended to have a bore therethrough surrounded by dense, pore-free metal. The apparatus comprises a plunger core adapted to be driven into a die cavity during metal solidification. The plunger core is driven towad a stationary core. The opposed tips of the plunger core and stationary core are preferably semi-spherical and displace or deflect metal laterally as the plunger core advances to collapse shrink pores in the metal that form during cooling and solidification. In addition to densifying the metal, the plunger core and the stationary core form recesses in the product casting that form the basis of a bore through the article. Although the apparatus and method are generally satisfactory for densification, a significant amount of metal remains between the recesses, so that a relatively expensive drilling operation is required to complete the bore. It is desired to reduce the cost of bore completion by eliminating the necessity for drilling while assuring densified metal about the bore along its entire length.

Therefore, it is an object of this invention to provide an improved process and apparatus for casting metal to form a cast article having a bore substantially therethrough and surrounded by densified metal substantially free of shrink porosity, which casting comprises driving a movable core member into the metal during solidification to substantially form the bore in the casting and concurrently to densify the metal about the bore along its entire length More particularly, it is an object of this invention to provide a plunger core incorporated within a cavity-defining die casting apparatus and adapted to be driven into partially solidified metal within the cavity to form a bore in a product casting, which plunger core comprises a tip adapted to laterally displace metal as the core is driven into the metal, thereby densifying the metal about the bore. The tip is adapted to be received into a recess within an opposite cavity-defining wall such that the plunger core extends substantially through the cavity to substantially form the entire bore and further such that, at most, a thin metal flash remains between the tip and the wall, suitable for removal by a punching or similar operation to complete the bore without the necessity of a relatively expensive drilling operation. Metal is densified about the bore along substantially the entire length as a result of the plunger core being driven through the cavity.

SUMMARY OF THE INVENTION

In a preferred embodiment, these and other objects are accomplished by a die casting apparatus adapted for molding a metal casting having an enlarged section intended to have a straight, axial bore therethrough. The apparatus comprises die sections that cooperate to define a cavity suitably sized and shaped to substantially form the casting, except for the bore, and including an enlarged region for forming the enlarged casting section. A plunger core is slidably mounted within a die section and adapted to extend through the enlarged cavity region to substantially form the bore. The plunger core is axially movable between a retracted position for filling the region of the intended bore with metal during casting and an extended, bore-forming position. The plunger core comprises a conical tip adapted to plow into and laterally displace partially solidified metal within the cavity in response to advance of the plunger core from the retracted position into the bore-forming position. An axially aligned, correspondingly shaped, conical recess located within a cavity-defining wall opposite the plunger core is adapted to receive the tip when the plunger core is in the bore-forming position.

For casting, the plunger core is initially retracted and the cavity, including the enlarged region and the region of the intended bore, is filled with molten metal. A the metal cools and solidifies, it shrinks within the cavity, whereupon pores form in the metal, particularly within the enlarged region, which is slower cooling because of its size. After the metal is partially solidified, but while still in an extrudable state, the plunger core is driven tip-first into the metal toward the opposite recess such that the tip comes to rest within the recess. After the advance, the plunger core extends through the enlarged region to substantially form the bore. The plunger core advance is accommodated by metal displaced laterally by the conical tip. This lateral displacement collapses shrink pores about the bore over the distance of the advance, that is, over substantially the entire bore length. Thereafter, the metal is further cooled to complete solidification, the plunger core is retracted, the die sections are opened, and the product casting is removed.

In addition to densifying the metal, lateral displacement by the conical tip results in only a relatively small amount of metal trapped between the tip and the corresponding wall of the recess. The trapped metal forms an unwanted thin flash covering an end of the bore in the product casting. The flash is readily and relatively inexpensively removed, and the bore is completed, preferably by a punch directed through the bore.

DETAILED DESCRIPTION OF THE INVENTION

Figure 1:
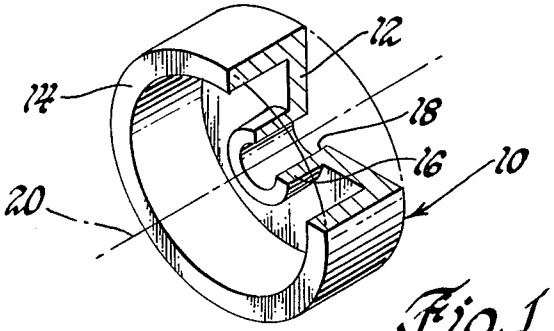
FIG. 1 is a perspective view of an article suitable for die casting in accordance with this invention.

For purposes of illustration, an embodiment of this invention is described for producing an article 10 shown in FIG. 1. Article 10 comprises a flat circular plate 12 and a peripheral wall 14. Article 10 also comprises a relatively massive hub section 16. Hub section 16 defines a bore 18 completely therethrough and cylindrical about an axis 20, which is perpendicular to plate 12. While this invention is directed to densifying the metal in hub section 16, densification is not necessarily limited thereto, but may advantageously extend to wall 14 under appropriate circumstances.

Figure 2:
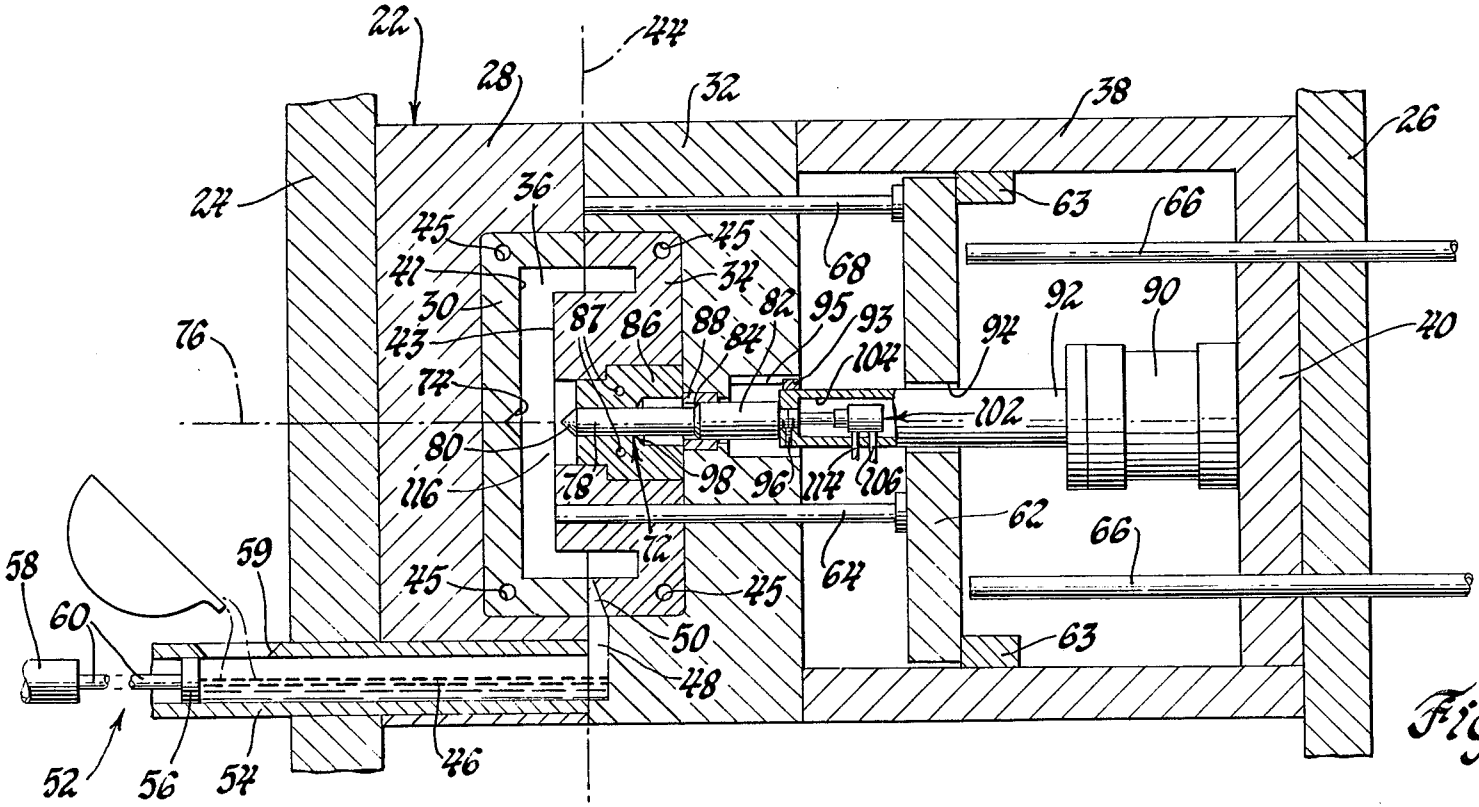
FIG. 2 is a cross sectional view of a die casting apparatus comprising a plunger core and an aligned recess for densifying metal and forming a bore in accordance with this invention.

A preferred die casting apparatus 22 in FIG. 2 is adapted to sequentially produce a plurality of articles 10. Apparatus 22 comprises a stationary platen 24 and a movable platen 26. Stationary platen 24 carries a cover die block 28 wherein is mounted a water-cooled die half section 30. Movable platen 26 also carries a die block 32 wherein is mounted a second die half section 34. An ejector box 38 is located between movable platen 26 and die block 32 and comprises a back plate 40 fixed to platen 26. Platen 26 is reciprocably movable between a closed or forward position shown in FIG. 2 wherein die halves 30 and 34 mate and define a casting cavity 36 and an open or backward position shown in FIG. 6 for removing a product casting 42 that is substantially article 10. Die blocks 28 and 32 and die halves 30 and 34 part along line 44. Cavity 36 is defind by walls 41 and 43 of die halves 30 and 34, respectively, and is sized and shaped to substantially form article 10, except for bore 18. A plurality of passages 45 are provided in die halves 30 and 34 for circulating water coolant to cool the die halves and thereby cool metal in cavity 36.

Metal 46 is injected into cavity 36 through a runner 48 that runs along parting line 44 and a restricted ingate 50 between the runner and the cavity. A shot assembly 52 is provided for injecting the metal and comprises a shot sleeve 54 that extends through platen 24 and die block 28 and communicates with runner 48. A shot plunger 56 is slidably mounted within sleeve 54 and connected to a two cycle hydraulic cylinder 58 through a connecting rod 60. Plunger 56 is adapted to reciprocate between a retracted position shown in FIG. 2 for ladling metal 46 into sleeve 54 through an opening 59 and an extended position shown in FIG. 4 wherein metal is forced into runner 48 and thus into cavity 36.

Ejector box 38 houses an ejector plate 62 that is adapted to slide parallel to the movement of platen 26. During casting, plate 62 abuts stops 63. An ejector pin 64 fixed to plate 62 is slidably mounted through die block 32 and die half 34 and extends to cavity 36. Knockout bars 66 are slidably mounted through movable platen 26 and ejector box back plate 40. Knockout bars 66 are stationary and are sized and positioned so that, when platen 26 moves to open the die halves, bars 66 engage ejector plate 62 to urge ejector pin 64 through die half 34 and thereby urge a casting away from die half 34. Also fixed to plate 62 is a return pin 68 that is slidably mounted through die block 32 such that, when platen 26 moves to close the die halves, pin 68 engages die block 28 to slide plate 62 back into the position shown in FIG. 2.

Figure 3:
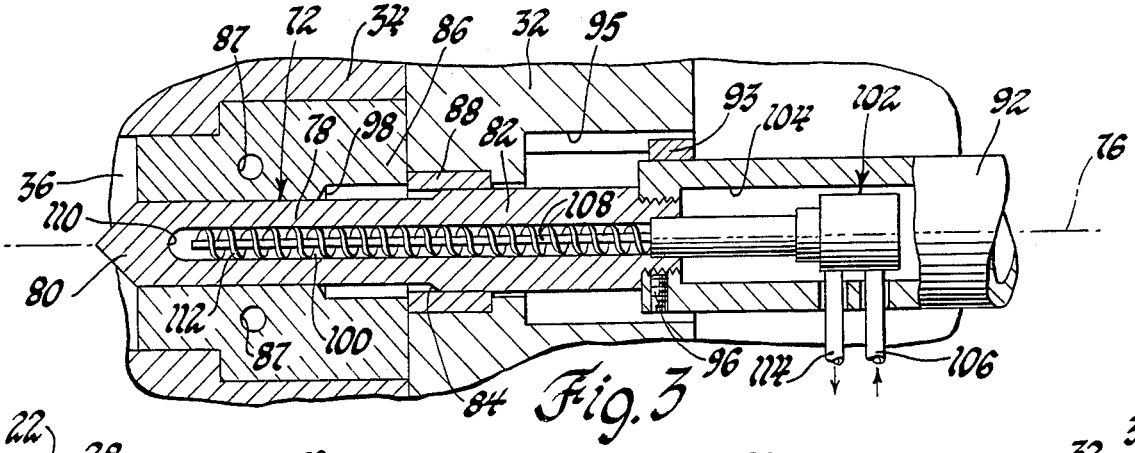
FIG. 3 is an enlarged, cross sectional view of the plunger core of FIG. 2 showing the details thereof.
Figure 5:
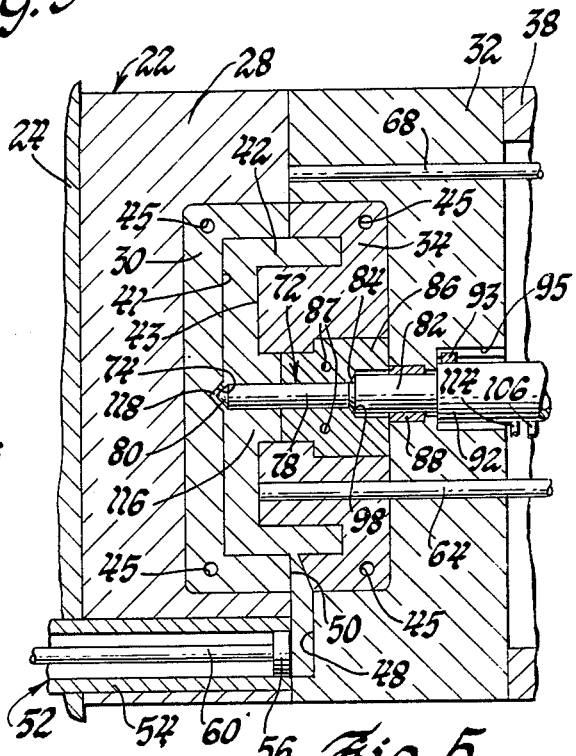
FIG. 5 is a partial view of the apparatus of FIG. 2, similar to FIG. 4, but showing the position of the plunger core after being driven into the metal for densification and bore formation.

Die casting machine 22 also comprises a plunger core 72 and an aligned recess 74 for densifying metal and forming a bore 75 in a product casting 42, which substantially forms bore 18 in article 10. Referring to FIGS. 2 and 3, plunger core 72 is generally cylindrical about an axis 76 that coincides with bore axis 20 of article 10 as the article is being formed in cavity 36. Plunger core 72 comprises a metal penetration portion 78 having a conical tip 80 adjacent cavity 36, a relatively wider connecting portion 82 and a shoulder 84 therebetween. The penetration portion 78 is snugly but slidably fitted in a sleeve 86 secured in die half 34 and cooled by water circulating through passages 87. The connecting portion 82 extends through die block 32 and is slidably held in a guidance bushing 88. Plunger core 72 is movable along axis 76 between a retracted position shown in FIG. 2 for filling cavity 36 with metal and an advanced position shown in FIG. 5 for forming bore 75 in casting 42. Plunger core 72 is driven by a two cycle hydraulic cylinder 90 mounted onto the ejector box back plate 40 and is connected thereto by a connecting rod 92 that extends through an opening 94 in ejector plate 62. The connection portion 82 is threadably mounted into the end of connecting rod 92 and held by a set screw 96. Connecting rod 92 comprises a key 93 adapted to axially slide in a cooperating keyway 95 in die block 32 for guidance. A mechanical stop 98 in sleeve 86 is adapted to engage shoulder 84 of plunger core 72 to prevent further advance.

Plunger core 72 is provided with a central axial passage 100 for circulating cooling water. Water is directed into passage 100 by a fountainhead 102 that is conveniently positioned in a chamber 104 in the connecting rod 92. Fountainhead 102 receives water through an inlet pipe 106 and directs the water down a central axial pipe 108 in passage 100 such that the water impinges upon an inner end passage surface 110 opposite conical tip 80. The water returns to fountainhead 102 about pipe 108 guided by a helical vane 112. Fountainhead 102 accumulates the water for removal through an outlet pipe 114. The cooling of the plunger core 72 is described in further detail in U.S. patent application Ser. No. 391,104, incorporated herein by reference.

Recess 74 is located in cavity-defining wall 41 of die half 30 opposite plunger core 72 and aligned along axis 76. Recess 74 has a conical shape corresponding to that of tip 80 and is adapted to receive tip 80. Stop 98 in sleeve 86 is positioned to halt plunger core 72 such that tip 80 just fits in recess 74, and to prevent plunger core 72 from advancing further and forcing apart die halves 30 and 34.

Figure 4:
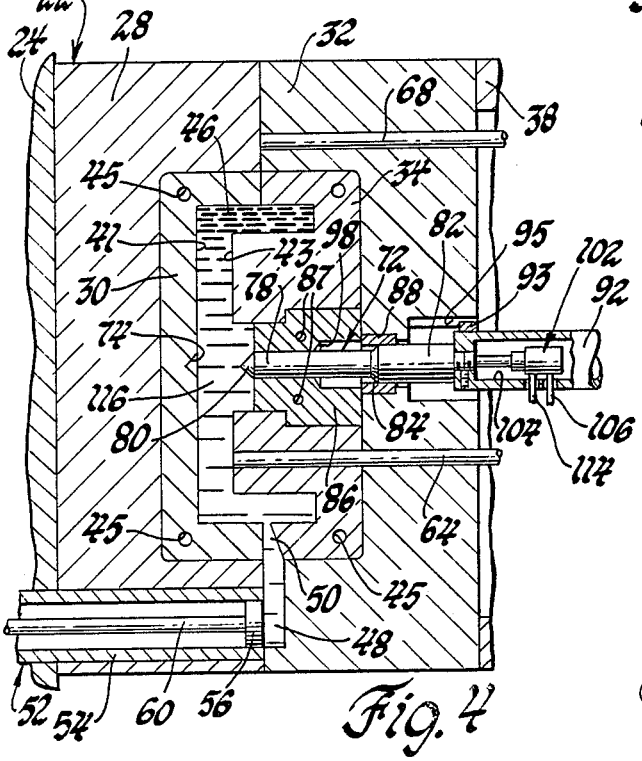
FIG. 4 is a partial view of the apparatus of FIG. 2 showing the position of the die elements including the plunger core after melt has been injected into the cavity.

The operation of die casting machine 22 will now be described. Initially platen 26 is moved into the position shown in FIG. 2 to close die halves 30 and 34 to form cavity 36, and plunger core 72 is retracted. With shot plunger 56 in the retracted position, the charge of molten metal 46 is poured into shot sleeve 54 through opening 59. Shot plunger 56 is then advanced, slowly at first until the metal charge 46 just fills the sleeve, and then fast to rapidly inject the metal through runner 48 and ingate 50 into cavity 36, filling the cavity, as shown in FIG. 4. The pressure applied by the shot plunger to the metal to fill the cavity is between about 6,000 to 9,000 psi. After filling, an intensification pressure between about 12,000 to 18,000 psi is applied by the shot plunger to reduce the size of trapped air bubbles and feed initial shrinkage.

In cavity 36, heat is extracted from the metal into water-cooled die halves 30 and 34, as well as into retracted water-cooled plunger core 72, causing the metal to begin solidification. The metal completely solidifies first at restricted ingate 50, blocking metal flow therethrough. After ingate solidification, the shot intensification pressure is no longer effective to feed shrinkage in cavity 36. Also, metal in cavity 36 cannot flow back into runner 48, despite pressure applied by plunger core 72 in accordance with this invention.

Thermal contraction and the liquid-to-solid phase change reduces the metal volume so that it no longer fills cavity 36, whereupon pores form in the metal. Shrink pores are particularly a problem in enlarged region 116 which forms hub section 16 and cools slower because of its relatively large mass. After shrinkage has proceeded to where the cumulative pore volume is sufficient to accommodate the volume of displaced metal, but while the metal is still in a partially solidified and extrudable state, hydraulic cylinder 90 is actuated to drive plunger core 72 into the position shown in FIG. 5 to collapse the pores and form the bore. After its advance, plunger core 72 extends through region 116 with tip 80 resting within recess 74. The pressure applied by plunger core 72 to penetrate the metal is preferably between about 20,000 to 30,000 psi. If plunger core 72 is actuated too early before sufficient shrinkage and while the metal is predominantly liquid, die halves 30 and 34 may be forced apart and the casting ruined. 0n the other hand, core 72 is driven into the metal before it has completely solidified, since solid metal requires substantially greater deformation pressure, typical of forging operations. Between these extremes, it is preferred to time the core advance to optimize densification in hub-forming region 116. The pressure applied by core 72 is hydraulically distributed by the liquid phase of the partially solidified metal. Plunger core 72 is preferably actuated when sufficient metal has solidified so that the liquid phase is not continuous throughout the casting, but while the metal in slower cooling region 116 contains sufficient liquid to facilitate densification. This allows the densification pressure to be concentrated within region 116. As core 72 plows through the metal, tip 80, because of its conical shape, displaces metal radially. This radial displacement preferentially collapses shrink pores near axis 76 to produce solid metal about bore 75 and thus about bore 18. Because plunger core 72 is driven substantially through region 116, metal is densified along the entire length of bore 75.

In addition to assuring dense metal about the intended bore, conical tip 80 of plunger core 72 reduces the pressure required to penetrate the metal. Molten metal initially solidifies near walls 41 and 43 of cavity 36. Thus, a solid metal skin forms over plunger core tip 80. When the plunger core 72 is actuated, the conical shape aids to break through and shed the solid metal skin, so that the tip does not drag solid metal through the partially solidified metal. Thus, the pressure required to drive core 72 is reduced and core tip 80 is freed to direct the metal in the desired directions.

A metal skin also solidifies adjacent recess 74. Because of the conical shape of recess 74 and the below-forging pressure applied by plunger core 72, this metal is not displaced and becomes wedged between tip 80 and recess 74, forming a flash 118 over the end of bore 75 in casting 42. Because of flash 118, shoulder 84 does not generally engage stop 98. Flash 118 is typically thin, being on the order of a few thousandths of an inch. Thus, after plunger core 72 is driven into the advanced position shown in FIG. 5, the plunger core extends substantially through the body of cast metal to form bore 75, with only the thin flash 118 covering the end thereof.

Figure 6:
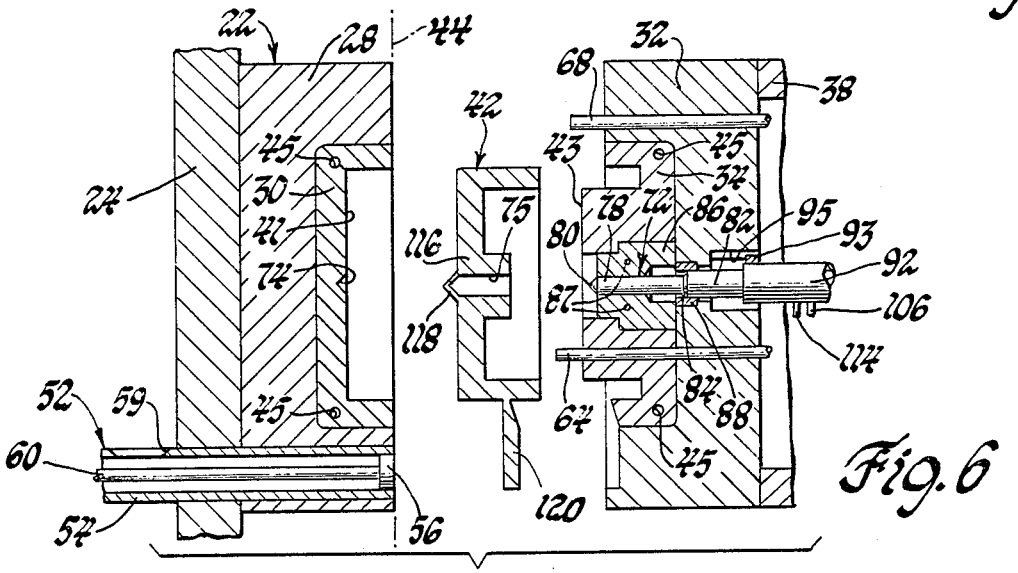
FIG. 6 is a partial view of the apparatus in FIG. 2, similar to FIGS. 4 and 5, and showing the position of the die elements after the metal has solidified and the apparatus is opened for ejecting the product casting.

After plunger core 72 is driven into the metal, cooling continues until the metal has completely solidified. Hydraulic cylinder 90 is then reversed to retract plunger core 72. Plaen 26 is moved away from platen 24 to part die halves 30 and 34, as shown in FIG. 6. As platen 26 moves away, knockout bar 66 engages ejector plate 62 to cause ejector pin 64 to push casting 42 away from die half 34 for removal. Thereafter, platen 26 is cycled forward to close the die halves to produce another casting, whereupon return pin 68 engages die block 28 and causes ejector plate 62 to slide into the position shown in FIG. 2.

As seen in FIG. 6, product casting 42 comprises a bore 75 formed by core 72 in the hub region 116 and closed at one end by a thin, conical flash 118. Flash 118 is readily removed by directing a punch through bore 75 to complete the bore 18 through article 10. Unwanted runner-derived metal 120 is trimmed away to finish casting 42 to complete article 10.

As a result of the metal densification produced by the plunger core in accordance with this invention, the metal about the bore is dense and substantially free of shrink porosity. Although this invention forms a bore through a product casting, a reaming operation may be employed to finish size the bore to a desired diameter. Also, reaming may be necessary to enlarge the bore to a desired size, since the as-cast size of the bore is limited by the porosity available to accommodate displaced metal.

In the preferred embodiment the plunger core tip and aligned recess have conical shapes. Other shapes, such as semispherical, are also suitable for plowing through the metal and laterally displacing it. Also, the tip need not be symmetrical about the axis, but may be suitably shaped to preferentially displace metal in a particular lateral direction, provided the recess is correspondingly shaped.

While this invention has been disclosed principally in terms of a particular embodiment, it is not intended to be limited to that embodiment, but rather only to the extent set forth in the following claims.

The embodiments of the invention in which aan exclusive property or privilege is claimed are defined as follows:

1. A metal casting apparatus for forming a metal casting having a bore substantially therethrough and surrounded by densified metal, said apparatus comprising metal molding means for defining a cavity for receiving and molding molten metal and for cooling to solidify the metal therein to form the casting, whereupon voids form in the metal as a result of shrinkage, a core member axially movably supported in said metal molding means and extendable substantially through the cavity for forming a bore substantially through the casting, said core member comprising a metal-penetrating lead surface suitably shaped to displace metal laterally in response to axial movement that extends said core member into the cavity, receptacle means within said metal molding means opening into said cavity and operative to receive said metal-penetrating core member surface, and means for axialy driving said core member into said cavity such that the lead surface penetrates partially solidified metal therein and is received in the receptacle means, said driving thereby extending the core member substantially through the cavity for bore formation and causing lateral metal displacement that collapses voids in metal about the bore.

2. A metal casting apparatus for forming a metal casting having a bore substantially therethrough and surrounded by dense, nonporous metal, said apparatus comprising a die body for defining a substantially fixed-volume cavity suitably sized and shaped for molding molten metal to substantially form the casting and adapted to receive molten metal into the cavity and to cool metal therein to effect solidification to form the casting, whereupon voids form in the metal as a result of shrinkage during cooling, a core member slideably mounted in the die body and extendable substantially through the cavity along an axis for substantially forming a bore in a casting formed therein, said core member being axially movable between a retracted position for filling the cavity with molten metal and an advanced position for forming the bore, said core member comprising a tip for penetrating metal within the cavity as the core member advances and suitably shaped to laterally displace metal in response to said advance, a recess within the die body opening into the cavity axially aligned with the core member for receiving the core member tip when the core member is in the advanced position, said recess being correspondingly shaped to said tip, and means for axially advancing the core member from the retracted position into the advanced position while said cavity contains metal in a partially solidified, extrudable state, such that the core member tip penetrates metal and is received in the recess, said core member advance thereby substantially forming the bore and being accommodated by lateral metal displacement that collapses voids in metal about the bore.

3. A die casting apparatus for forming a metal casting having an enlarged section defining an axial bore extending substantially therethrough, said apparatus being adapted to densify metal in the enlarged section during casting such that the bore is surrounded by dense, pore-free metal and comprising two cooled die sections having walls that cooperate to define a fixed-volume metal molding cavity for receiving molten metal and suitably molding the molten metal to shape the casting, said cavity including an enlarged region for forming the enlarged casting section except for the bore, said sections being relatively movable between a closed cavity-defining position and an open position for removing a product casting, said sections being suitably cooled to solidify molten metal within the cavity, whereupon shrinkage of the metal produces pores in the enlarged region, means for injecting molten metal into the cavity through an ingate sized and located such that metal solidifies to seal the ingate while metal within the enlarged region is partially solidified and in an extrudable state, a plunger core member slidably mounted in a said die section and axially extendable into the enlarged cavity region through a said die wall to form a bore therethrough, said plunger core member being axially movable between a retracted position for injecting metal into the cavity including the enlarged region and an advanced position wherein the plunger core member extends through the enlarged region to define the bore, said plunger core member having a conical tip for axially penetrating and laterally displacing extrudable metal, a recess in a said die wall opening into the enlarged cavity region and axially aligned with said plunger core member, said recess being correspondingly conically shaped and located to receive said plunger core member tip when said plunger core member is in the advanced position, and means for axially driving the plunger core member toward the recess from the retracted position into the advanced position to cause said plunger core member to penetrate extrudable metal within the enlarged cavity region and to be received within the recess such that at most a thin metal flash lies therebetween suitably for punching removal, whereby said plunger core member advance substantially forms the bore through the enlarged region and is accommodated by lateral metal displacement that collapses pores in metal about the bore.

4. A process for forming a metal casting having a bore substantially therethrough surrounded by dense, void-free metal, said process comprising filling a fixed-volume cavity defined within a mold with molten metal to shape the metal to substantially form the casting except for the bore, said mold having a recess opening into the cavity adjacent one end of the desired bore, cooling the metal within the cavity to partially solidify the metal, whereupon shrinkage produces voids therein, driving a core member into the partially solidified metal within the cavity to substantially form the bore, said driving being carried out such that a metal-penetrating tip of the core member is received into the recess and further such that metal is laterally displaced to accommodate the core member, said lateral metal displacement collapsing voids in metal about the bore, and cooling the metal to complete solidification to form the casting.

5. A process for forming a cast metal article having a bore therethrough defined by dense, nonporous metal, said process comprising injecting molten metal into a fixed-volume cavity defrned within a die body, said cavity being suitably sized and shaped to mold the metal to substantially a desired shape of the article except for the bore, cooling the metal within the cavity to partially solidify the metal to produce an extrudable state therein, said cooling being accompanied by shrinkage that produces pores in the metal, driving a plunger core member through the cavity while metal therein is in the partially solidified but extrudable state, said plunger core member having a conical metal-penetrating tip that displaces extrudable metal laterally in response to penetration by the plunger core member to thereby collapse pores in metal about the plunger core member, said tip being driven into a correspondingly conically shaped recess within the die body opening into the cavity such that a thin metal flash forms therebetween, said driven core member thereby substantially forming the bore in the metal except for said flash and densifying metal about the bore, further cooling the metal within the die body to complete solidification to form the casting, removing the casting from the die body, and directing a suitable punch through the bore to remove the thin metal flash to complete the bore to thereby form the article.

* * * * *